US009348300B2

(12) United States Patent
Takemoto et al.

(10) Patent No.: US 9,348,300 B2
(45) Date of Patent: May 24, 2016

(54) UNIT RETRACTION DEVICE AND IMAGE FORMING APPARATUS INCLUDING SAME

(71) Applicant: KYOCERA Document Solutions Inc., Osaka (JP)

(72) Inventors: Mitsutoshi Takemoto, Osaka (JP); Katsuhiro Yoshiuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/577,816

(22) Filed: Dec. 19, 2014

(65) Prior Publication Data

US 2015/0185685 A1 Jul. 2, 2015

(30) Foreign Application Priority Data

Dec. 26, 2013 (JP) ..... 2013-269286
Apr. 28, 2014 (JP) ..... 2014-092414

(51) Int. Cl.
*G03G 15/00* (2006.01)
*G03G 21/16* (2006.01)

(52) U.S. Cl.
CPC ..... *G03G 21/1661* (2013.01); *G03G 21/1647* (2013.01); *G03G 15/6502* (2013.01); *G03G 2221/1654* (2013.01); *G03G 2221/1684* (2013.01)

(58) Field of Classification Search
CPC ..... G03G 21/1615; G03G 21/1633; G03G 21/1647; G03G 21/1661; G03G 21/1803; G03G 21/1821; G03G 21/1842; G03G 2221/1654; B65H 2405/121
See application file for complete search history.

(56) References Cited

U.S. PATENT DOCUMENTS 4,603,239 A * 7/1986 Ishii ..... E05B 17/22 200/61.61
2010/0007081 A1 1/2010 Miki ..... 271/225
2011/0031681 A1 2/2011 Miki ..... 271/121

FOREIGN PATENT DOCUMENTS

JP 2006-327823 A 12/2006
JP 2010-18406 A 1/2010
JP 2011-37540 A 2/2011
JP 2012-148868 A 8/2012

* cited by examiner

*Primary Examiner* — David Gray
*Assistant Examiner* — Andrew V Do
(74) *Attorney, Agent, or Firm* — Stein IP, LLC

(57) ABSTRACT

A unit retraction device has a hook member which engages with an engaged portion provided on a unit, and a retraction force generating mechanism which exerts a retraction force on the unit. The retraction force generating mechanism includes a first rotary member which is rotatably disposed on a first rotation pivot and to a rotating end part of which the hook member is coupled, a biasing member of which one end is hooked to the first rotary member and which biases the first rotary member in such a direction that the hook member retracts the unit into the apparatus body, and a second rotary member to which another end of the biasing member is hooked and which is rotatably disposed on a second rotation pivot. The second rotary member rotates in the same direction as the first rotary member as the latter is rotated by the biasing member.

10 Claims, 12 Drawing Sheets

UNIT RETRACTION DEVICE AND IMAGE FORMING APPARATUS INCLUDING SAME

INCORPORATION BY REFERENCE

This application is based upon and claims the benefit of priority from the corresponding Japanese Patent Applications Nos. 2013-269286 and 2014-92414 filed on Dec. 26, 2013 and Apr. 28, 2014 respectively, the entire contents of both of which are incorporated herein by reference.

BACKGROUND OF THE INVENTION

The present disclosure relates to a unit retraction device for retracting into an apparatus body a unit that is extractably and insertably loaded in the apparatus body, and to an image forming apparatus, such as a copier, printer, or facsimile machine, provided with such a unit retraction device.

Conventionally, an image forming apparatus such as a copier, printer, or facsimile machine is, in a bottom part of its apparatus body, provided with a paper feed cassette for accommodating a plurality of sheets of paper (recording medium) in such a way that the paper feed cassette is extractable out of the apparatus body. By a feeding means, comprising a pickup roller or the like, arranged over the paper feed cassette and by a separating/transporting means, comprising a paper feed roller pair or the like, the paper accommodated in the paper feed cassette is fed out one sheet after another so as to be transported to an image formation section and on to a fusing device, so that an image is formed on the paper.

In an image forming apparatus as mentioned above, the paper feed cassette is loaded into and unloaded out of the apparatus body manually by a user on occasions of paper replenishment and paper size change. On such occasions, the paper feed cassette may not be completely inserted into a predetermined position (loaded position) inside the apparatus body. In that case, the paper feed cassette is positioned improperly, leading to an image being formed off the center of the paper in its width direction, or to transport failure.

Moreover, the paper feed cassette along with the paper accommodated in it may turn out to be so heavy that the user finds difficulty inserting the paper feed cassette into the loaded position. For easier handling of the paper feed cassette, there have been proposed various retraction devices for retracting the paper feed cassette into the loaded position inside the apparatus body.

For example, in one known retraction device, when the paper feed cassette has been loaded up to a predetermined position, engagement by an engaging portion of the retraction device is released so that a retraction force is discontinued. In another known retraction device, a force storing means is provided which, after engaging with a sheet accommodating means, gradually stores a retraction force as the sheet accommodating means moves in the loading direction, wherein retraction into the loaded position is achieved by releasing the retraction force in the force storing means before or after the retraction force by a retracting means becomes maximal.

A known image forming apparatus is provided with a retraction force generating means comprising a plurality of biasing members which generate biasing forces in different biasing directions and a plurality of rotary members for generating a retraction force from the biasing forces of those biasing members. Yet another retraction device is provided with a restricting member which suppresses increase in retraction speed by generating a load commensurate with the retraction speed with which a paper feed tray is retracted. This retraction device can suppress increase in the retraction speed of the paper feed tray, and can thereby suppress impact during loading of the paper feed tray.

SUMMARY OF THE INVENTION

According to one aspect of the present disclosure, a unit retraction device is provided with a hook member and a retraction force generating mechanism, and retracts into a retraction completion position inside an apparatus body a unit that is insertably or extractably loaded in the apparatus body. The hook member engages with an engaged portion provided on the unit. The retraction force generating mechanism exerts a retraction force on the unit when the hook member engages with the engaged portion in a retraction start position of the unit. The retraction force generating mechanism includes a first rotary member which is rotatably disposed on a first rotation pivot and to a rotating end part of which the hook member is coupled, a biasing member of which one end is hooked to the first rotary member and which biases the first rotary member in such a direction that the hook member retracts the unit into the apparatus body, and a second rotary member to which the other end of the biasing member is hooked and which is rotatably disposed on a second rotation pivot. The second rotary member rotates in the same direction as the first rotary member as the first rotary member rotates under the biasing force of the biasing member.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
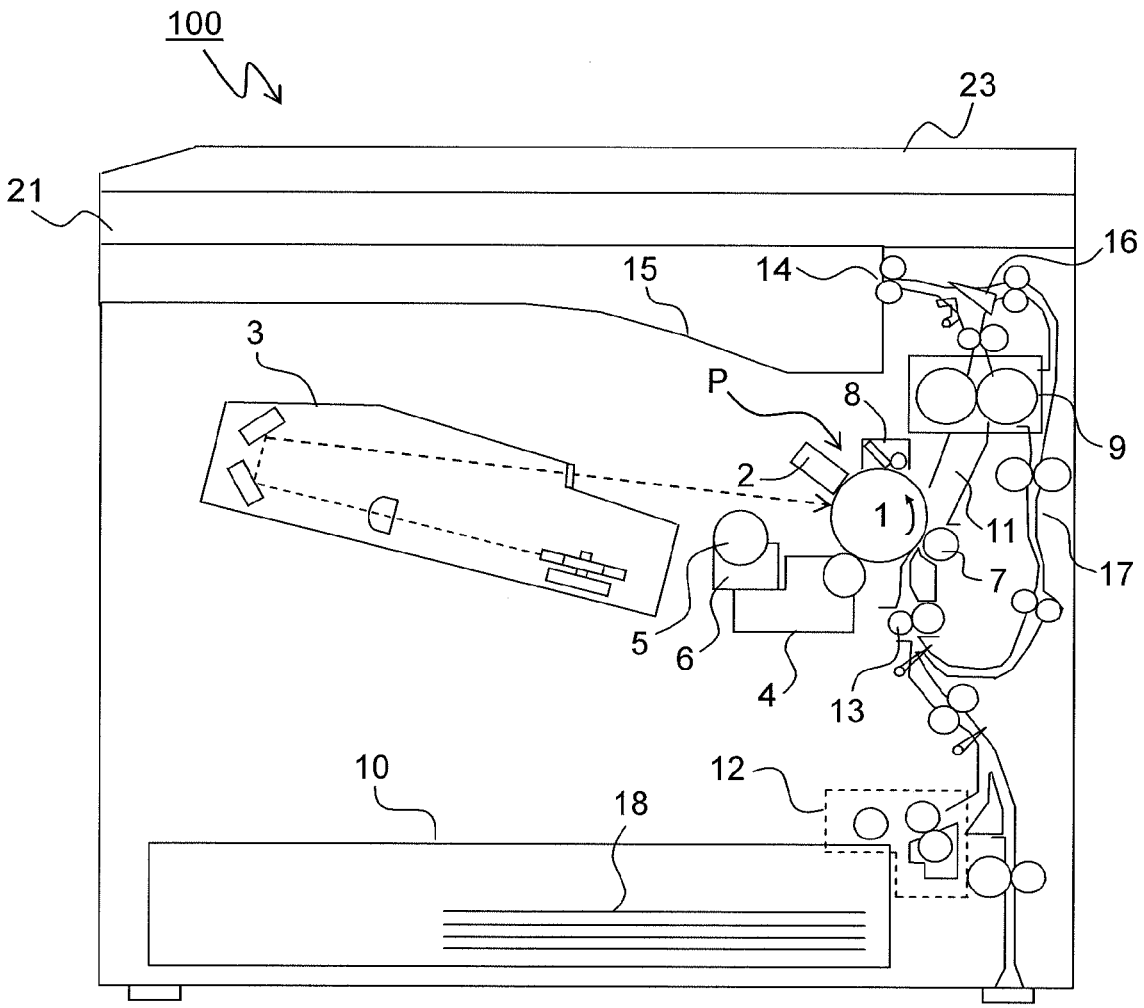
FIG. 1 is an outline sectional view of an image forming apparatus 100 provided with a unit retraction device 50 according to the present disclosure.
Figure 2:
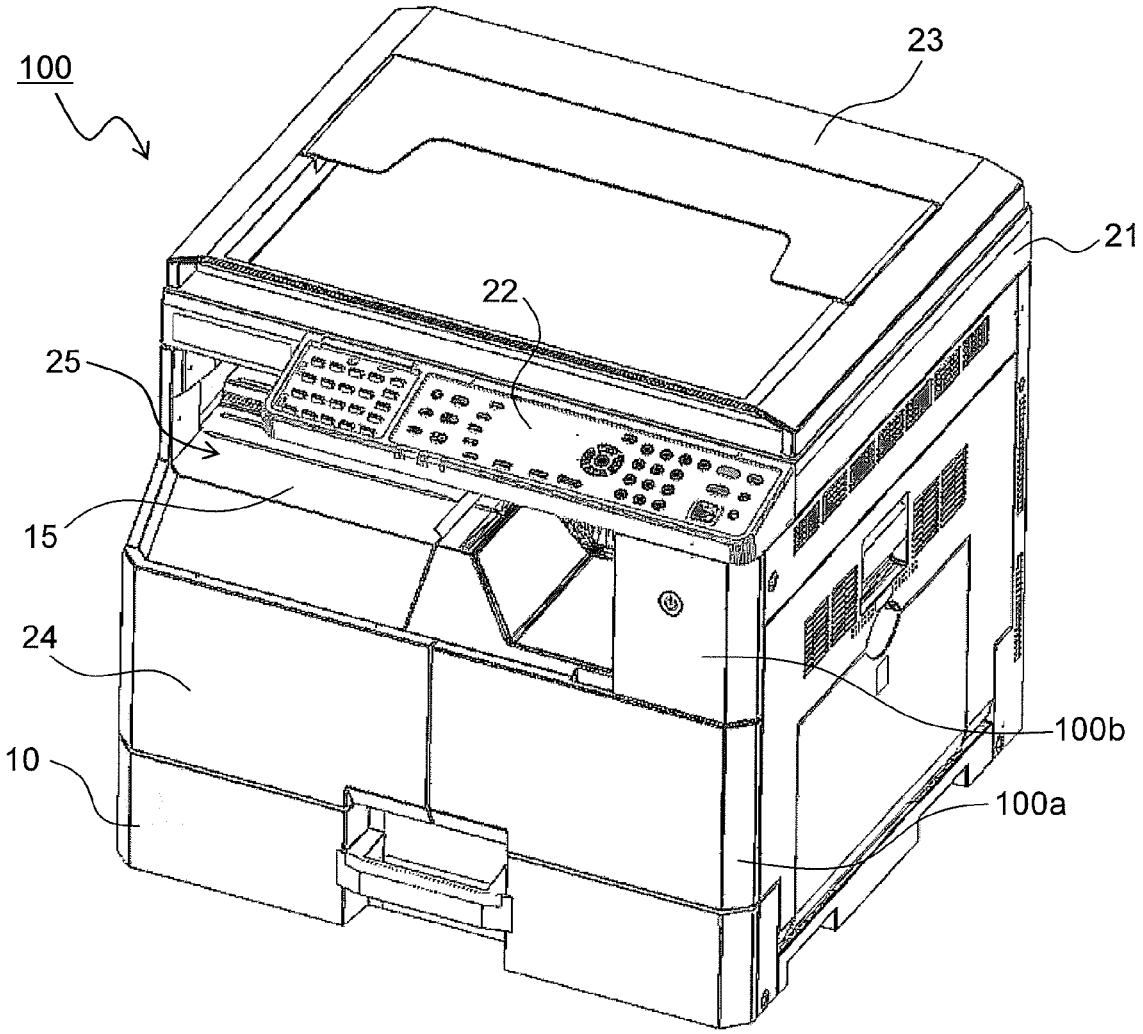
FIG. 2 is an exterior perspective view of the image forming apparatus 100 as seen from in front of FIG. 1.

Hereinafter, with reference to the accompanying drawings, embodiments of the present disclosure will be described. FIG. 1 is an outline sectional view of an image forming apparatus 100 provided with a unit retraction device 50 according to the present disclosure. FIG. 2 is an exterior perspective view of the image forming apparatus 100 as seen from in front (from in front of FIG. 1). Taken here as the image forming apparatus 100 is a monochrome multifunction peripheral. Inside the body of the image forming apparatus 100, an image formation section P is arranged which forms a monochrome image through processes of electrical charging, exposure, development, and transfer.

In the image formation section P, there are arranged, along the rotation direction of a photosensitive drum 1 (in the counter-clockwise direction in FIG. 1), a charging device 2, an exposure unit 3, a developing device 4, a transfer roller 7, a cleaning device 8, and a destaticizing device (unillustrated). In the image formation section P, while the photosensitive drum 1 is rotated in the counter-clockwise direction in FIG. 1, an image formation process is performed on the photosensitive drum 1.

The photosensitive drum 1 has, for example, a photosensitive layer laid on the surface of an aluminum drum, and its surface is electrically charged by the charging device 2. The surface is then irradiated with a laser beam from the exposure unit 3, which will be described later, to form an electrostatic latent image through attenuation of electrical charge. While there is no particular restriction on the material of the above-mentioned photosensitive layer, it is particularly preferable to use, among others, amorphous silicon (a-Si), which excels in durability, or an organic photoconductor (OPC) layer, which generates little ozone and yields a high-resolution image.

The charging device 2 electrically charges the surface of the photosensitive drum 1 uniformly. Used as the charging device 2 is, for example, a corona discharger which achieves electrical discharge by applying a high voltage to an electrode comprising a thin piece of wire or the like. Instead of a corona discharger, a contact-type discharger can be used which applies a voltage to the photosensitive surface with a charging member, as exemplified by a charging roller, kept in contact with it. The exposure unit 3 shines, based on original image data read by an image reading section 21, a light beam (for example, laser beam) on the photosensitive drum 1 to form an electrostatic latent image on its surface.

The developing device 4 makes toner attach to the electrostatic latent image on the photosensitive drum 1 to form a toner image. The developing device 4 is supplied with toner from a toner container 5 via an intermediary hopper 6. Here, one-component developer (hereinafter also referred to simply as toner) composed of a magnetic toner component alone is contained in the developing device 4.

The transfer roller 7 transfers, without disturbing, the toner image formed on the surface of the photosensitive drum 1 to paper that comes transported through a paper transport passage 11. The cleaning device 8 includes a cleaning roller or cleaning blade that makes line contact with the photosensitive drum 1 in its longitudinal direction, and removes residual toner, that is, the toner that remains on the surface of the photosensitive drum 1 after transfer of the toner image to the paper.

The image reading section 21 is composed of a scanning optical system, which includes a scanner lamp for illuminating a document during copying and a mirror for deflecting the light from the document; a condenser lens for condensing and focusing the light reflected from the document; and a CCD sensor for converting the focused image light into an electrical signal (none is illustrated) or the like. The image reading section 21 reads a document image and converts it into image data.

During copying, the image reading section 21 reads the image data of a document and converts it into an image signal. On the other hand, in the image formation section P, while the photosensitive drum 1 is rotated in the counter-clockwise direction in FIG. 1, it is electrically charged uniformly by the charging device 2. The photosensitive drum 1 is then irradiated with a laser beam (ray) by the exposure unit 3 based on the document image data read by the image reading section 21, so that an electrostatic latent image based on the image data is formed on the surface of the photosensitive drum 1. The developing device 4 then makes toner attach to the electrostatic latent image to form a toner image.

Toward the image formation section P where the toner image has thus been formed, paper 18 is fed out of a paper feed cassette 10 by a paper feed unit 12, so that the paper is transported to the image formation section P with predetermined timing through the paper transport passage 11 and via a registration roller pair 13. Then, in the image formation section P, the toner image on the surface of the photosensitive drum 1 is transferred to the paper 18 by the transfer roller 7. The paper 18 having the toner image transferred to it is separated from the photosensitive drum 1, and is transported to a fusing device 9, where the toner image is fused to the paper 18 under heat and pressure.

The paper 18 having passed through the fusing device 9 has its transport direction switched by a bifurcating portion 16 between two directions. When an image is formed on only one side of the paper 18, the paper 18 is discharged onto a discharge tray 15 by a discharge roller pair 14.

On the other hand, when images are formed on both sides of the paper 18 respectively, the paper 18 having passed through the fusing device 9 is first transported toward the discharge roller pair 14, and then, after the tail end of the paper 18 has passed by the bifurcating portion 16, the discharge roller pair 14 is rotated in the reverse direction and the bifurcating portion 16 so switches the transport direction as to feed the paper 18, from its tail end, into a reversing transport passage 17, so that the paper 18, with the image side reversed, is transported once again to the registration roller pair 13. The next image formed on the photosensitive drum 1 is then transferred by the transfer roller 7 to the side of the paper 18 where no image has been formed yet. The paper 18 is then transported to the fusing device 9, where the toner image is fused, and is then discharged onto the discharge tray 15.

As shown in FIG. 2, on the top face of the image reading section 21, there are arranged a document table (unillustrated) fitted with a transparent glass plate (contact glass) and an operation panel 22 which protrudes frontward from the body of the image forming apparatus 100. Moreover, on the top face of the image reading section 21, a platen (document presser) for pressing the document placed on the document table is supported in an openable/closable fashion.

At the front face of a housing 100*a*, a front cover 24 is provided in an openable/closable fashion. Opening the front cover 24 allows maintenance and replacement of members inside the housing 100*a*.

Figure 3:
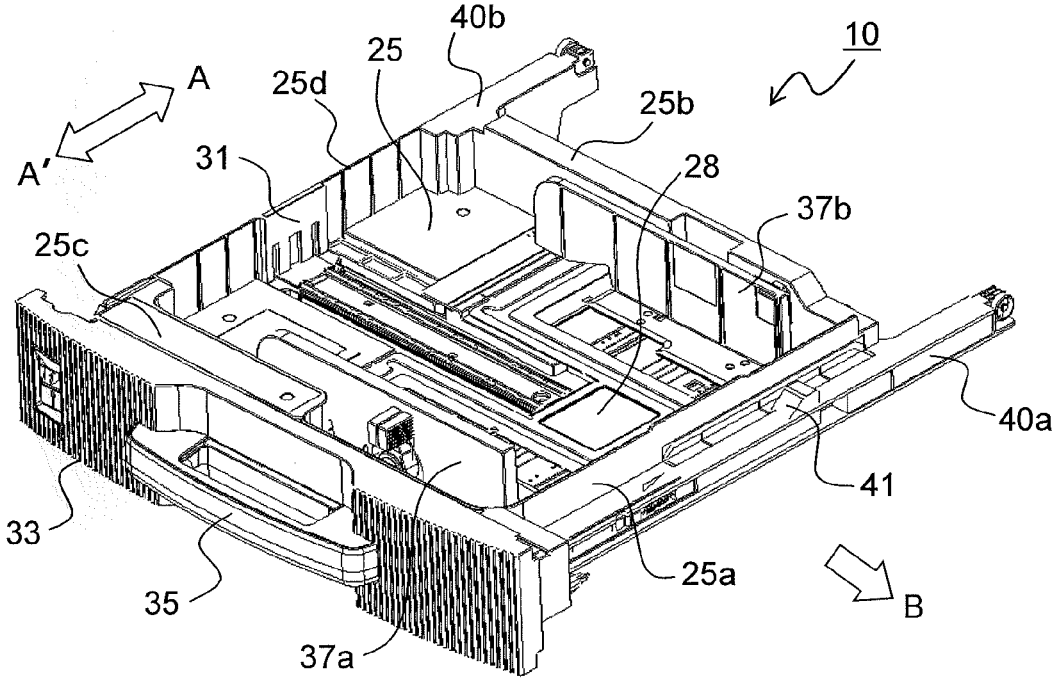
FIG. 3 is an exterior perspective view of the paper feed cassette 10 loaded in the image forming apparatus 100.

FIG. 3 is an exterior perspective view of the paper feed cassette 10 loaded in the image forming apparatus 100. The lower left side of FIG. 3 corresponds to the front side of the image forming apparatus 100 (the fore side in FIG. 2). In FIG. 3, the insertion direction of the paper feed cassette 10 with respect to the housing 100*a* is indicted by arrow A, the extraction direction of the paper feed cassette 10 with respect to the housing 100*a* is indicated by arrow A', and the paper feed direction of the paper feed cassette 10 is indicated by arrow B.

As shown in FIG. 3, around the four edges of a cassette base 25 which constitutes the bottom face of the paper feed cassette 10, walls 25*a* to 25*d* are provided upright. The upstream-side wall 25*c* with respect to the insertion direction of the paper feed cassette 10 is fitted with a cassette cover 33. A front-side (left-side in FIG. 3) part of the cassette cover 33 is exposed to the outside, and forms a part of the exterior surface of the body of the image forming apparatus 100 (see FIG. 2). In a central part of the cassette cover 33, a grip 35 is provided which can be gripped during loading and unloading of the paper feed cassette 10.

A paper stack plate 28, on which paper 18 (see FIG. 1) is stacked, is pivoted on a left and a right swing shaft (at opposite ends in the direction indicated by arrows A and A') so that a downstream-side part of the paper stack plate 28 with respect to the paper transport direction (the direction indicated by arrow B in FIG. 2) can be raised and lowered relative to the cassette base 25. At opposite ends of the paper stack plate 28 in its width direction, there is provided a pair of width adjustment cursors 37*a* and 37*b* for positioning, in the width direction, the paper 18 stacked on the paper stack plate 28. The width adjustment cursors 37*a* and 37*b* are each reciprocally movable in the paper width direction (the direction indicated by arrows A and A' in the figure) along a guide groove formed in the cassette base 25.

Since paper is fed out in the direction indicated by arrow B toward the paper transport passage 11 (see FIG. 1), a tail-end cursor 31 for aligning the tail end of the paper 18 is provided so as to be reciprocally movable parallel to the paper transport direction (the direction indicated by arrow B in the figure) along a guide groove formed in the cassette base 25. Moving the width adjustment cursors 37*a* and 37*b* and the tail-end cursor 31 to suit the size of the stacked paper permits the paper 18 to be accommodated in a predetermined position inside the paper feed cassette 10.

The walls 25*a* and 25*b* parallel to the insertion and extraction direction of the paper feed cassette 10 (the direction indicated by arrows A and A') are, on their respective outer faces, fitted with guide rails 40*a* and 40*b*. In the body (housing 100*a*) of the image forming apparatus 100, support portions (unillustrated) are provided which slidably support the guide rails 40*a* and 40*b*. Sliding the guide rails 40*a* and 40*b* along the support portions permits the paper feed cassette 10 to be inserted into and extracted out of the housing 100*a*.

Figure 4:
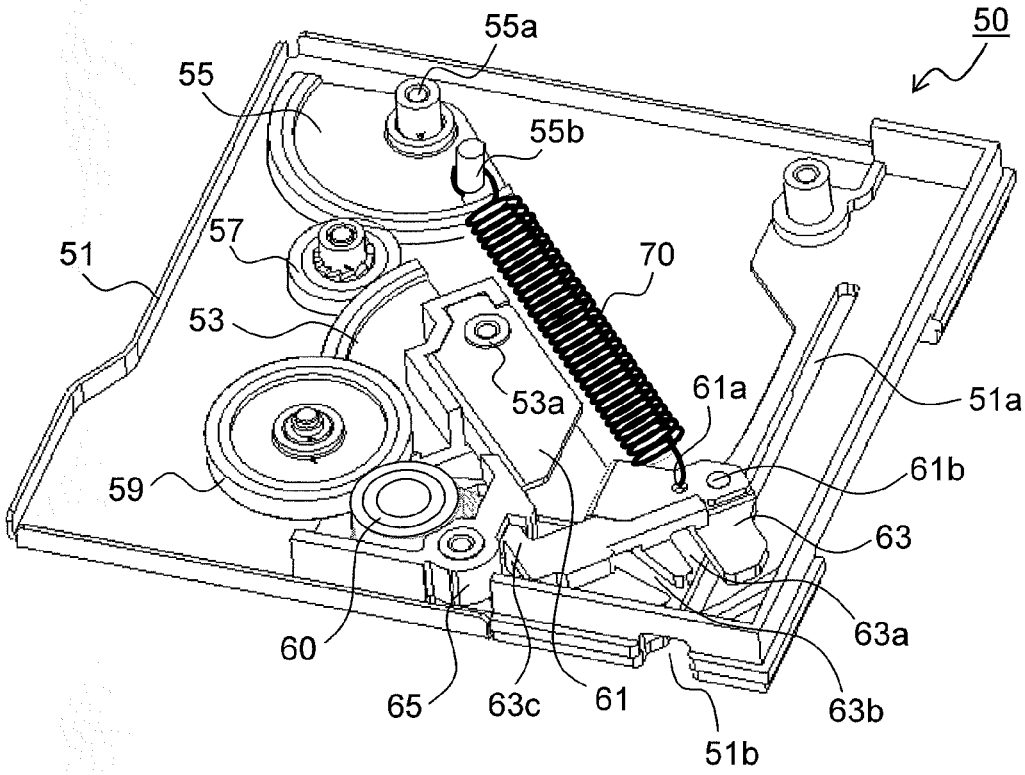
FIG. 4 is a perspective view showing a unit retraction device 50, in a state without a cover, according to a first embodiment of the present disclosure.

Next, a description will be given of a unit retraction device 50 for assisting insertion of the paper feed cassette 10. FIG. 4 is a perspective view showing a unit retraction device 50 according to a first embodiment of the present disclosure which is incorporated in the image forming apparatus 100. For the sake of convenience, FIG. 4 omits illustration of a cover on a housing 51 to expose the structure inside.

As shown in FIG. 4, the unit retraction device 50 has the function of retracting the paper feed cassette 10 into a predetermined position (paper feed position) inside the image forming apparatus 100, and on the bottom face of the housing 51, there are arranged a second gear 55, a first gear 53, an idle gear 57, a double gear 59, a rotary damper 60, a damper holder 65, etc.

On the bottom face of the housing 51, a guide groove 51*a* is formed along the insertion and extraction direction of the paper feed cassette 10 (the direction indicated by arrows A and A' in FIG. 3). An engagement projection 80 (see FIG. 5) formed on the paper feed cassette 10 is engaged with the guide groove 51*a*, and slides along the guide groove 51*a* as the paper feed cassette 10 is inserted and extracted. In a side face of the housing 51, an opening 51*b* is formed through which the engagement projection 80 is guided into the guide groove 51*a*.

The first and second gears 53 and 55 are each a fan-shaped gear rotatably supported on the bottom face of the housing 51 at a first or a second rotation pivot 53*a* or 55*a* respectively. The idle gear 57 meshes with both the second gear 55 and the first gear 53, and thereby permits the second gear 55 and the first gear 53 to rotate in the same direction.

The first gear 53 is meshed with a small-diameter portion of the double gear 59, and the rotary damper 60 is meshed with a large-diameter portion of the double gear 59. The rotary damper 60 generates a large load (attenuating force) when rotated at high speed, and generates a small load when rotated at low speed. The load is transmitted, as a braking force, to the double gear 59.

The double gear 59 is a one-way gear which can transmit a rotation driving force in one direction only. The small- and large-diameter portions of the double gear 59 are coupled together via a one-way mechanism, and the one-way mechanism achieves meshing in one direction only. Thus, only rotation in one direction is transmitted between the first gear 53 and the double gear 59 to permit the first gear 53 and the double gear 59 to rotate in synchronism. The one-way mechanism comprises, for example, a one-way clutch, a latch, or a ratchet.

Specifically, when the paper feed cassette 10 is retracted into the image forming apparatus 100, the first gear 53 rotates in the counter-clockwise direction in FIG. 4, and a rotation driving force is transmitted between the first gear 53 and the double gear 59 via the one-way mechanism. On the other hand, when the paper feed cassette 10 is extracted out of the image forming apparatus 100, the one-way mechanism interrupts transmission of the rotation driving force between the first gear 53 and the double gear 59, and thus the load from the rotary damper 60 is not transmitted from the double gear 59 to the first gear 53.

To the first gear 53, an arm member 61 is fixed. The arm member 61 is rotatable along with the first gear 53 about its rotation pivot, that is, the first rotation pivot 53*a*. To the rotating end of the arm member 61, a hook member 63 is coupled which is rotatable about a rotation pivot 61*b* relative to the arm member 61.

On the hook member 63, there are formed a first engagement groove 63*a* which is used in ordinary retraction operation; a second engagement groove 63*b* which is used in recovery operation from a state where the unit retraction device 50 is in a completely retracted state without achieving engagement with the engagement projection 80 of the paper feed cassette 10; and a locking portion 63*c* which engages with a claw portion 65*a* of the damper holder 65 to restrict movement of the hook member 63 thereby to restrict rotation of the arm member 61.

The arm member 61 has an engagement hole 61*a*, with which one end of a tension spring 70 is engaged, and the other end of the tension spring 70 is engaged with a boss portion 55*b* on the second gear 55. Thus, the arm member 61 is biased in the counter-clockwise direction about the first rotation pivot 53*a* by the tension spring 70.

Figure 5:
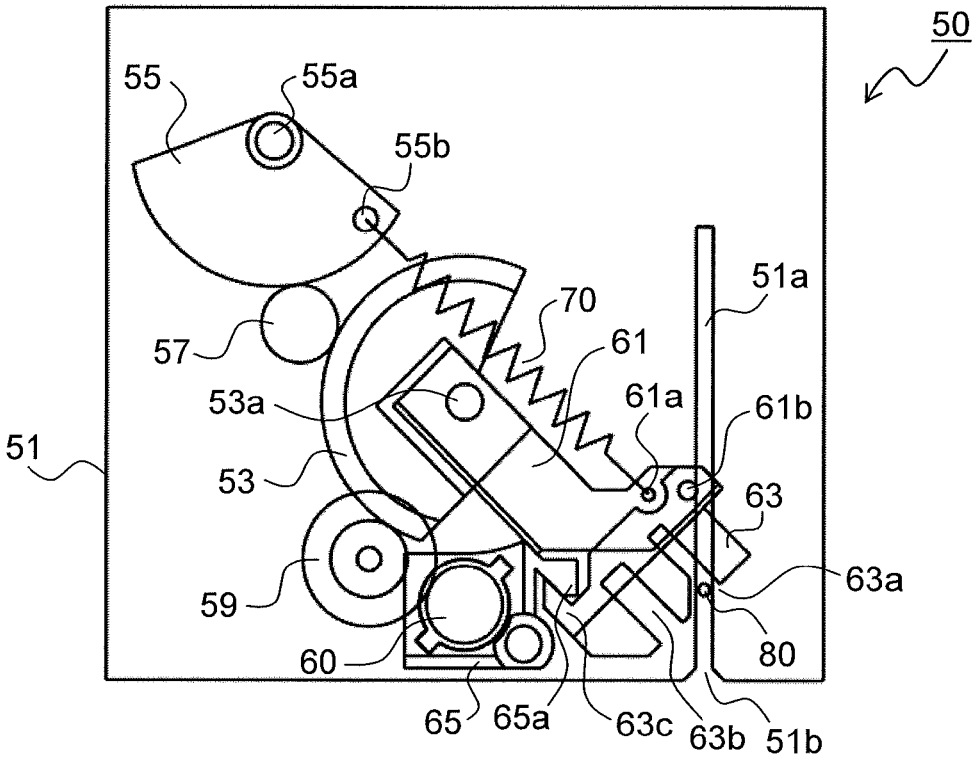
FIG. 5 is a plan view schematically showing a state of the unit retraction device 50 before insertion (before the start of retraction) of the paper feed cassette 10 in the first embodiment.

Next, with reference to FIGS. 5 to 9, the retraction operation of the paper feed cassette 10 by the unit retraction device 50 will be described. FIG. 5 is a plan view schematically showing a state of the unit retraction device 50 before insertion (before the start of retraction) of the paper feed cassette 10. In the state shown in FIG. 5, the locking portion 63*c* of the hook member 63 is engaged with the claw portion 65*a*, and the hook member 63 is held at the open end (retraction start position) of the guide groove 51*a*. The tension spring 70 is expanded from its natural length, and thus has a biasing force (retracting force) accumulated in it.

Figure 6:
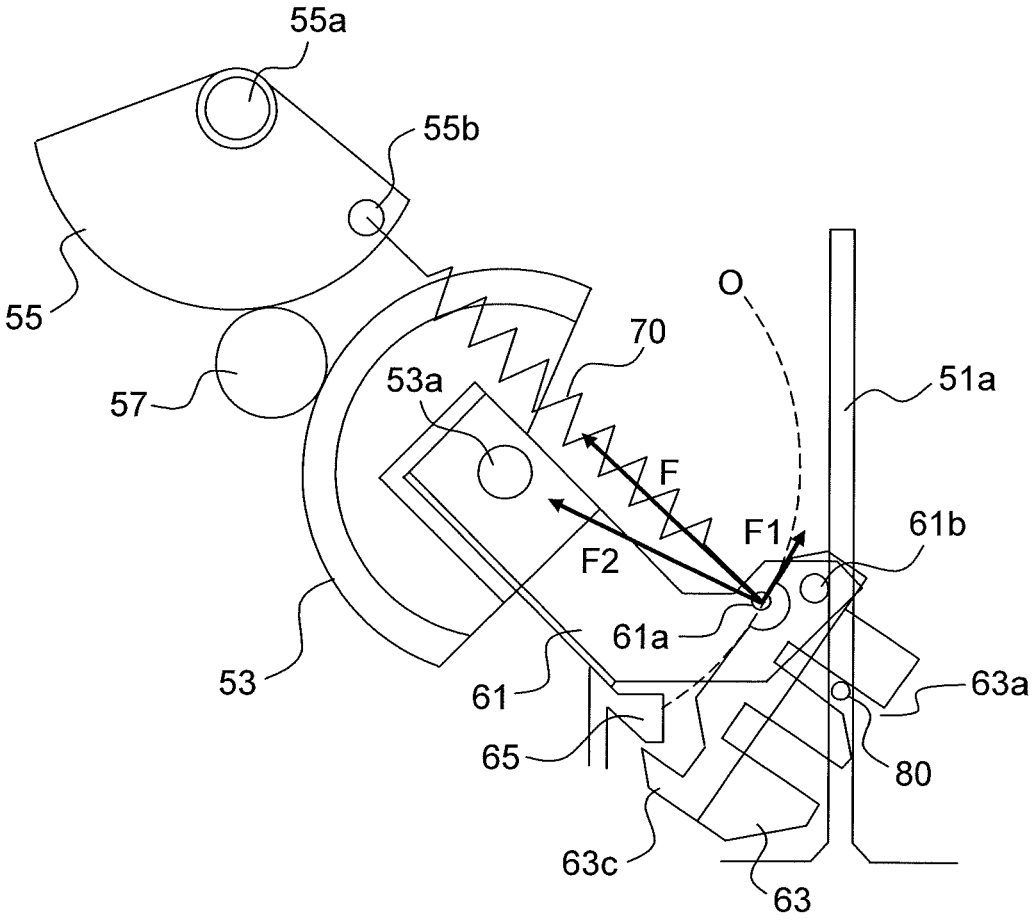
FIG. 6 is a plan view showing a state where, from the state shown in FIG. 5, the paper feed cassette 10 has been inserted over a predetermined distance into the body of the image forming apparatus 100 and the claw portion 65*a* and the locking portion 63*c* are disengaged from each other.

When the paper feed cassette 10 is inserted into the body of the image forming apparatus 100 over a predetermined distance, as shown in FIG. 6, the engagement projection 80 provided on the paper feed cassette 10 is inserted into the guide groove 51*a* through the opening 51*b* in the housing 51, and presses an inner face (the upper face in FIG. 6) of the first engagement groove 63*a* of the hook member 63. As a result, the hook member 63 rotates in the counter-clockwise direction about the rotation pivot 61*b*, and engagement between the claw portion 65*a* and the locking portion 63*c* is released. The disengagement causes the biasing force of the tension spring 70 to discontinue, and thus the inner face (the lower face in FIG. 6) of the first engagement groove 63*a* of the hook member 63 presses the engagement projection 80, thereby starting retraction of the paper feed cassette 10.

The biasing force F acting from the tension spring 70 to the engagement hole 61*a* of the arm member 61 can be split into a component force F1 that acts in the direction tangential to the rotation orbit O (indicated by a broken-line arc in the figure) of the engagement hole 61*a* and a component force F2 that acts from the engagement hole 61*a* to the rotation pivot (first rotation pivot 53*a*) of the arm member 61. The component force F1 is a rotation moment that makes the arm member 61 rotate, and acts as a force for retracting the paper feed cassette 10. In the state shown in FIG. 6, the direction of the biasing force F is close to the direction of the component force F2, and the component force F1 is smaller than the component force F2.

Figure 7:
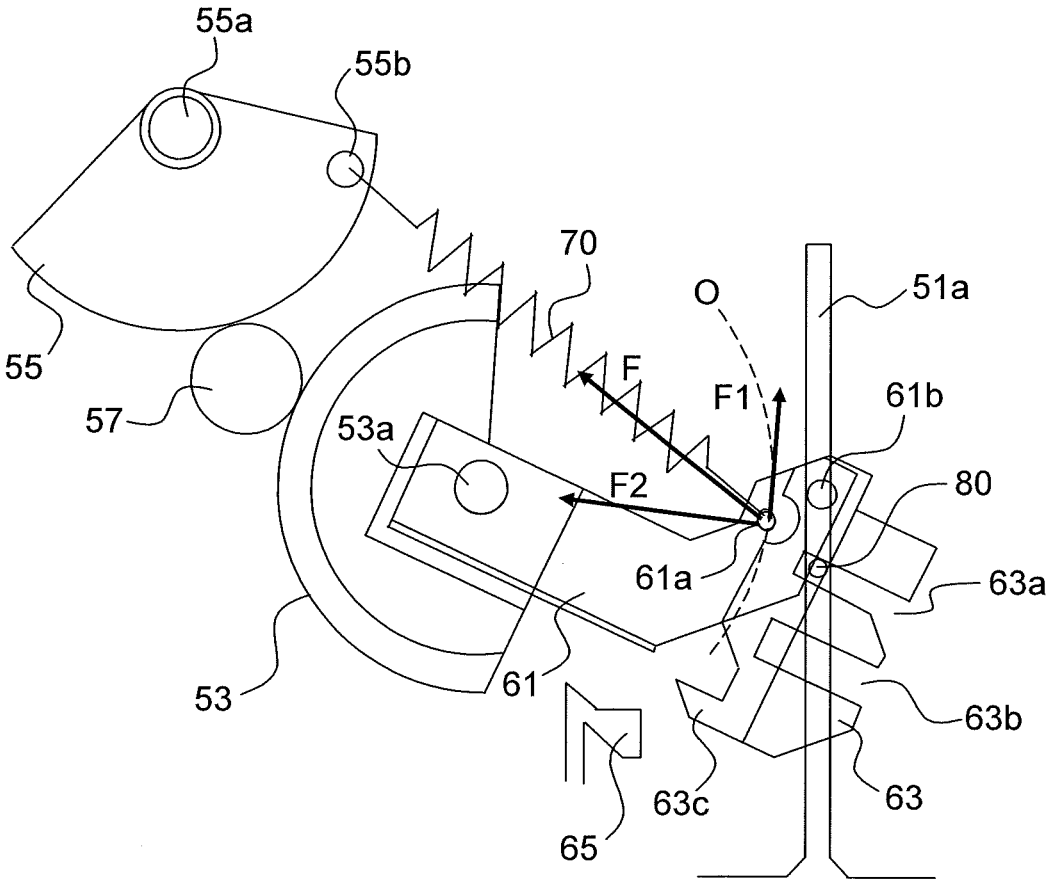
FIG. 7 is a plan view showing a state where, from the state shown in FIG. 6, the paper feed cassette 10 has been further retracted and the arm member 61 has rotated through a predetermined angle.

As the paper feed cassette 10 is retracted further from the state shown in FIG. 6 to the state shown in FIG. 7, under the biasing force from the tension spring 70, the arm member 61 and the first gear 53 rotate in the counter-clockwise direction about the first rotation pivot 53*a*. As the arm member 61 rotates, one end (the engagement hole 61*a*) of the tension spring 70 moves along the rotation orbit O in the counter-clockwise direction.

Meanwhile, the second gear 55, which is meshed with the first gear 53 via the idle gear 57, also rotates in the counter-clockwise direction about the second rotation pivot 55*a*. That is, the boss portion 55*b*, to which the other end of the tension spring 70 is hooked, rotates in the same direction as the engagement hole 61*a*, to which the one end of the tension spring 70 is hooked.

Specifically, as the arm member 61 rotates, one end of the tension spring 70 (the engagement hole 61*a*) rotates in the direction in which it approaches the other end of the tension spring 70 (the boss portion 55*b*), and the tension spring 70 contracts. Thus, the biasing force F becomes smaller. Meanwhile, however, also the boss portion 55*b* rotates in the direction away from the engagement hole 61*a*, and thereby reduces attenuation of the biasing force F resulting from contraction of the tension spring 70. Thus, the biasing force F only becomes slightly smaller than in FIG. 6. Moreover, the direction of the biasing force F changes away from the direction of the component force F2 and approaches the direction of the component force F1, and thus the component force F1 takes a larger proportion than in FIG. 6.

Figure 8:
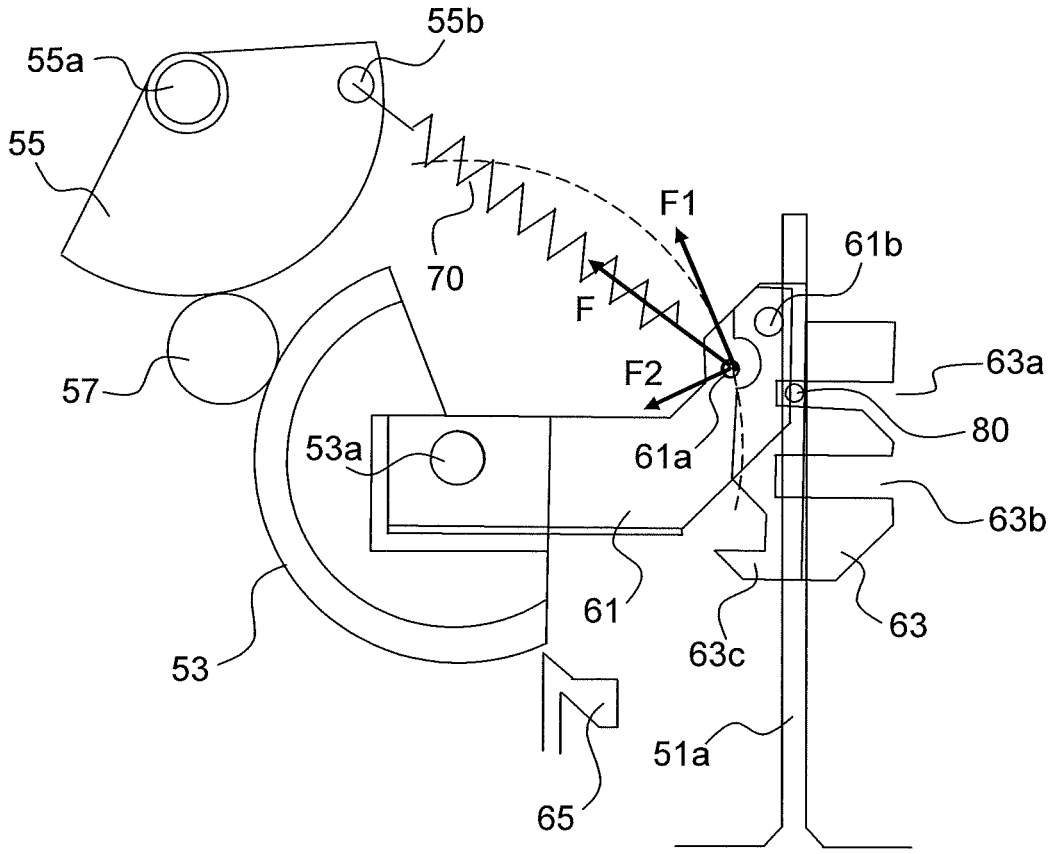
FIG. 8 is a plan view showing a state where, from the state shown in FIG. 7, the paper feed cassette 10 has been further retracted and the arm member 61 has rotated through a predetermined angle.

As the paper feed cassette 10 is retracted further from the state shown in FIG. 7 to the state shown in FIG. 8, both ends of the tension spring 70 moves further in the counter-clockwise direction. As the arm member 61 rotates, the tension spring 70 contracts and makes the biasing force F smaller. Meanwhile, however, the boss portion 55*b* rotates in the direction away from the engagement hole 61*a*, and thereby reduces attenuation of the biasing force F. Thus, the biasing force F becomes only slightly smaller than in FIG. 7. Moreover, the direction of the biasing force F further approaches the direction of the component force F1, and thus the component force F1 takes a larger proportion than in FIG. 7.

Figure 9:
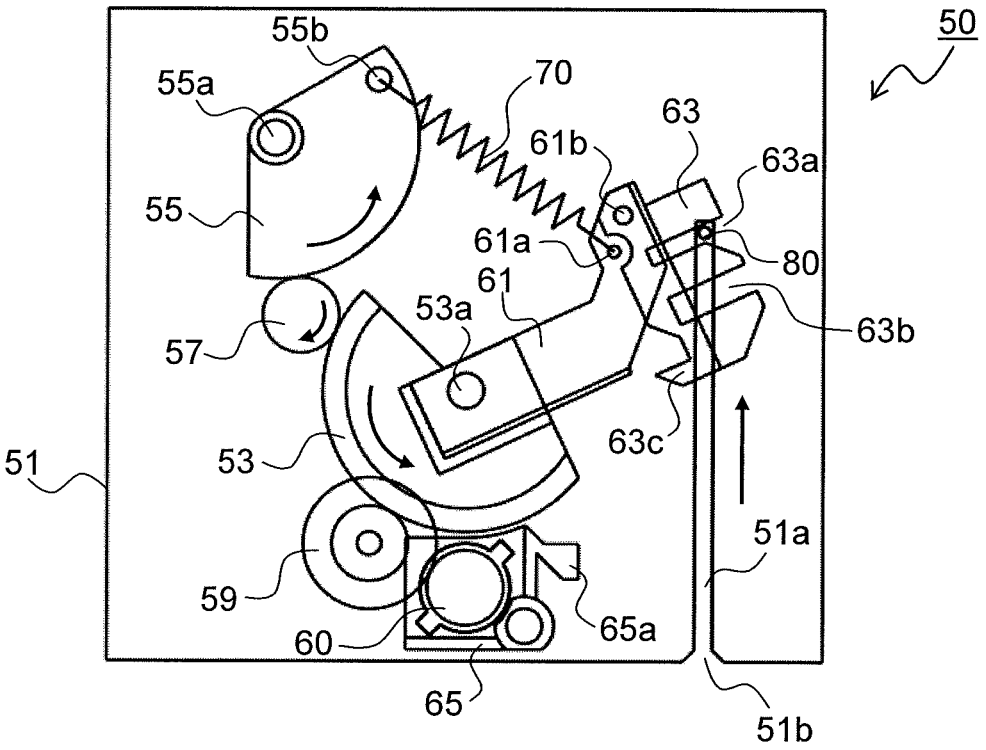
FIG. 9 is a plan view showing a state where the engagement projection 80 has moved up to the end point of the guide groove 51*a* and the paper feed cassette 10 has been retracted into a ready-to-feed-paper position (retraction completion position) inside the image forming apparatus 100.

When the engagement projection 80 moves up to the end point of the guide groove 51*a* as shown in FIG. 9, the paper feed cassette 10 is retracted into a ready-to-feed-paper position (retraction completion position) inside the image forming apparatus 100. Here, the ready-to-feed-paper position is defined by the engagement projection 80 making contact with the end point of the guide groove 51*a*. Instead, for example, the ready-to-feed-paper position can be defined by a contacting piece on the paper feed cassette 10 making contact with a contacted face on the image forming apparatus 100 before the engagement projection 80 reaches the end point of the guide groove 51*a*.

During the retraction operation of the paper feed cassette 10, the load (torque) from the rotary damper 60 acts on the first gear 53 via the double gear 59. For example, when the amount of paper accommodated in the paper feed cassette 10 is small, and thus the load of retracting the paper feed cassette 10 is small and the speed of retraction by the component force F1 is high, the rotary damper 60 exerts a large torque, reducing the retraction speed of the paper feed cassette 10. By contrast, when the amount of paper accommodated in the paper feed cassette 10 is large, and thus the load of retracting the paper feed cassette 10 is large, the rotary damper 60 exerts a small torque to prevent failure of retraction of the paper feed cassette 10 by the component force F1.

On the other hand, when the paper feed cassette 10 is extracted from the state shown in FIG. 9, the engagement projection 80 presses an inner face (the lower side face in FIG. 9) of the first engagement groove 63*a*. Thus, the arm member 61 rotates in the clockwise direction against the biasing force F of the tension spring 70 to go through the states shown in FIGS. 8, 7, and 6 in the reverse order, until eventually the locking portion 63*c* engages with the claw portion 65*a* to return the hook member 63 to the retraction start position as shown in FIG. 5. Then, the engagement projection 80 disengages from the guide groove 51*a*, and thus extraction of the paper feed cassette 10 is complete.

When the paper feed cassette 10 is extracted out of the image forming apparatus 100, the double gear 59, which is a one-way gear, interrupts transmission of a rotation driving force between the first gear 53 and the double gear 59, and thus the load of the rotary damper 60 is not transmitted to the first gear 53 and the arm member 61. Thus, the paper feed cassette 10 can be extracted smoothly without being affected by the load from the rotary damper 60.

Figure 10:
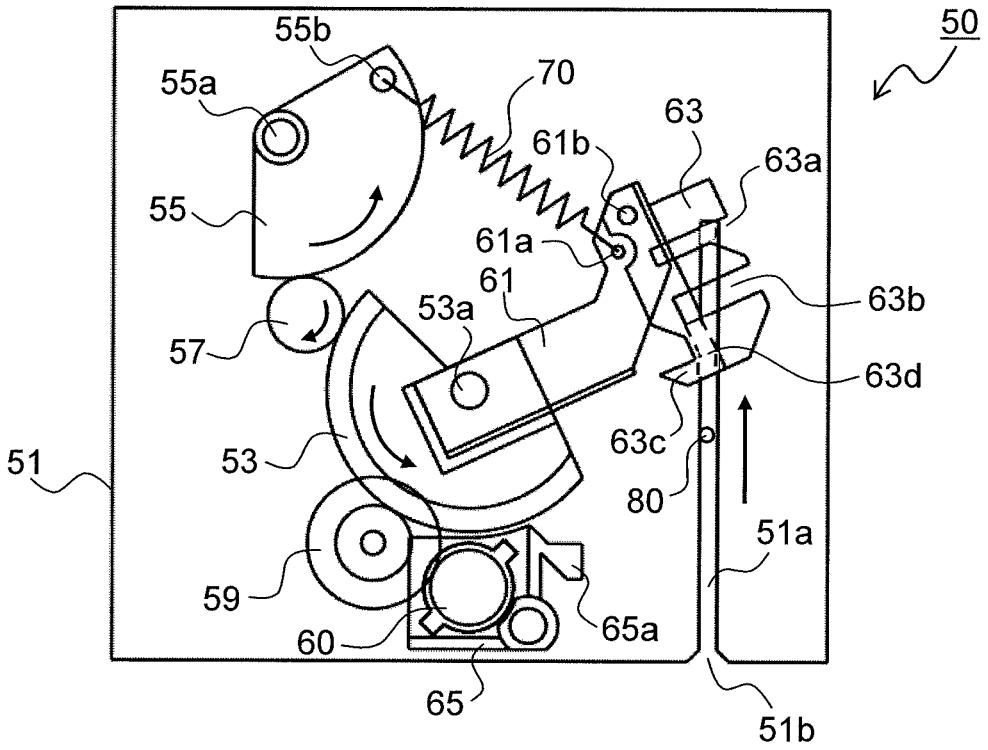
FIG. 10 is a plan view of the unit retraction device 50 according to the first embodiment, showing a state where the locking portion 63*c* and the claw portion 65*a* have disengaged from each other before insertion of the paper feed cassette 10 with the result that, despite the arm member 61 being in the retraction completion position, the engagement projection 80 and the hook member 63 are disengaged from each other.

If, before insertion of the paper feed cassette 10, some external force causes the locking portion 63*c* to disengage from the claw portion 65*a*, then, as shown in FIG. 10, although the unit retraction device 50 is in the retracted state and the arm member 61 is located in the retraction completion position (at the end point of the guide groove 51*a*), the engagement projection 80 remains disengaged from the hook member 63 (first engagement groove 63*a*) (engagement failure). Recovery from such engagement failure is achieved by use of the second engagement groove 63*b* and a guide groove 63*d* which communicates with the second engagement groove 63*b* from the upstream-side end of the hook member 63 with respect to its rotation direction.

Specifically, when, in the state shown in FIG. 10, the paper feed cassette 10 is inserted into the image forming apparatus 100 by ordinary operation, the engagement projection 80 passes from the guide groove 51*a* through the guide groove 63*d* into the second engagement groove 63*b*. When, in this state, the paper feed cassette 10 is extracted, the engagement projection 80 presses an inner face (the lower side face in FIG. 10) of the second engagement groove 63*b*, and thus the arm member 61 rotates in the clockwise direction against the biasing force F of the tension spring 70. Then, the locking portion 63*c* engages with the claw portion 65*a* of the damper holder 65, and the hook member 63 returns to the retraction start position. Thus, the unit retraction device 50 can be recovered to the state shown in FIG. 5 before insertion of (before retraction of) the paper feed cassette 10.

In the unit retraction device 50 according to this embodiment, the arm member 61 (and the first gear 53) to which one end of the tension spring 70 is hooked and the second gear 55 to which the other end of the tension spring 70 is hooked rotate in the same direction, and this reduces attenuation of the biasing force F of the tension spring 70 resulting from rotation of the arm member 61. Thus, it is possible to secure a predetermined or larger retracting force throughout the period from the start to the completion of retraction of the paper feed cassette 10, and thus to perform retraction operation smoothly.

Moreover, even after completion of retraction, a predetermined biasing force remains acting on the hook member 63. Thus, the engagement projection 80 can be reliably kept at the end point of the guide groove 51*a*. As a result, the paper feed cassette 10 can be stably kept loaded in the ready-to-feed-paper position inside the image forming apparatus 100.

Moreover, throughout the period from the start to the completion of retraction of the paper feed cassette 10, the rotation moment (component force F1), which makes the arm member 61 rotate, continues increasing. This, combined with the effect of reducing attenuation of the biasing force F achieved by rotation of the first and second gears 53 and 55 in the same direction, amplifies the force for retracting the paper feed cassette 10.

Moreover, coupling the first gear 53, to which the arm member 61 is fixed, with the rotary damper 60 permits the paper feed cassette 10 to be retracted into the image forming apparatus 100 at constant speed irrespective of the amount of paper accommodated inside the paper feed cassette 10.

Figure 11:
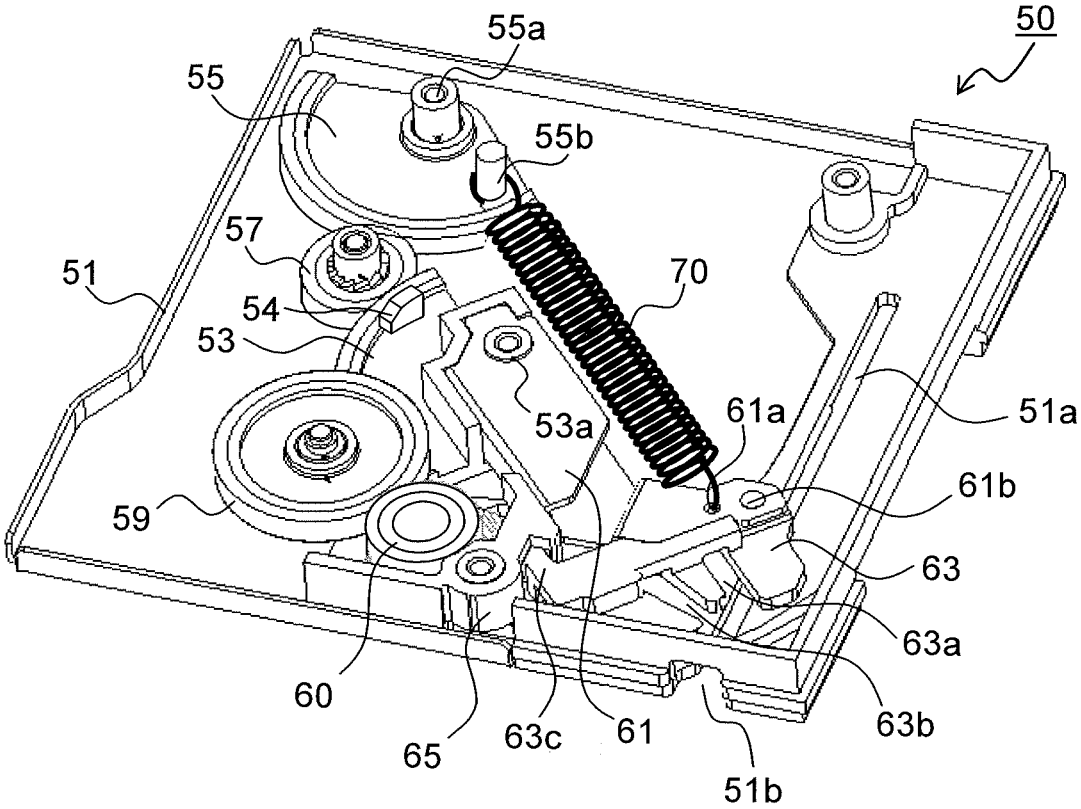
FIG. 11 is a perspective view showing a unit retraction device 50, in a state without a cover, according to a second embodiment of the present disclosure.
Figure 12:
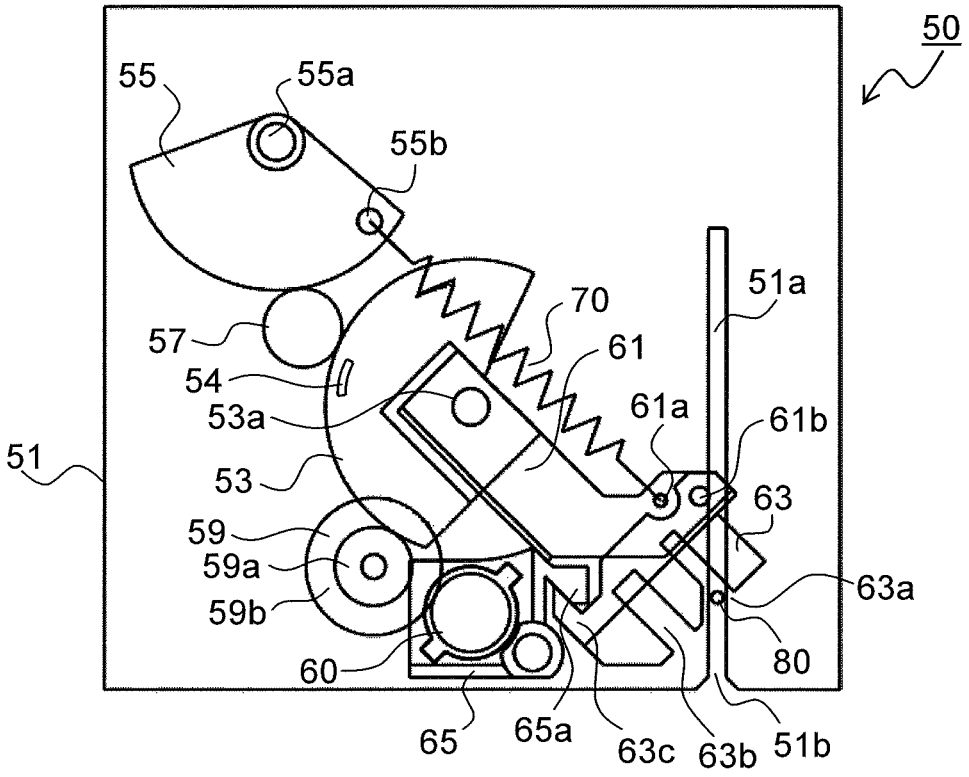
FIG. 12 is a plan view schematically showing a state of the unit retraction device 50 before insertion (before the start of retraction) of the paper feed cassette 10 in the second embodiment.
Figure 13:
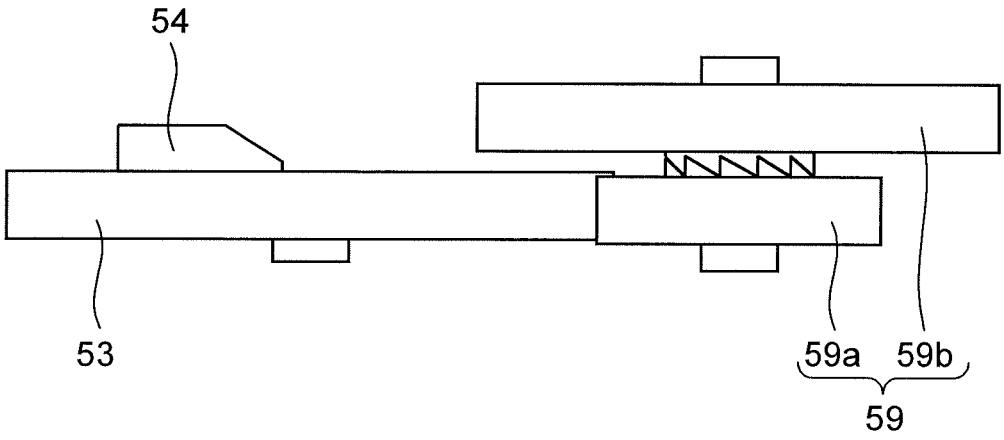
FIG. 13 is a side view showing a state where a large-diameter portion 59*b* and a small-diameter portion 59*a* of a double gear 59 provided in the unit retraction device 50 are located close together and are meshed with each other in the second embodiment.
Figure 14:
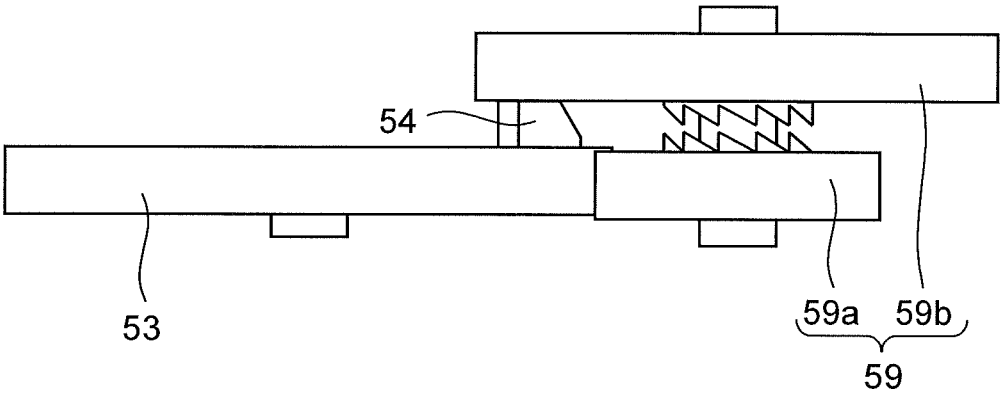
FIG. 14 is a side view showing a state where, from the state shown in FIG. 13, a projection portion 54 formed on a first gear 53 has intervened between the first gear 53 and the large-diameter portion 59*b* with the result that the large-diameter portion 59*b* has retracted to a position where it does not mesh with the small-diameter portion 59*a*.

FIG. 11 is a perspective view showing a unit retraction device 50 according to a second embodiment of the present disclosure. FIG. 12 is a plan view schematically showing a state of the unit retraction device 50 before insertion (before the start of retraction) of the paper feed cassette 10 in the second embodiment. FIG. 13 is a side view showing a state where a large-diameter portion 59*b* and a small-diameter portion 59*a* of a double gear 59 provided in the unit retraction device 50 are located close together and are meshed with each other in the second embodiment. FIG. 14 is a side view showing a state where a projection portion 54 formed on a first gear 53 has intervened between the first gear 53 and the large-diameter portion 59*b*, with the result that the large-diameter portion 59*b* has retracted to a position where it does not mesh with the small-diameter portion 59*a*. For the sake of convenience, FIG. 11 omits illustration of a cover on a housing 51 to expose the structure inside.

The structure of other parts of the unit retraction device 50 and the retraction operation of the paper feed cassette 10 by the unit retraction device 50 are similar to those in the first embodiment, that is, as shown in FIGS. 4 to 9. The recovery operation from the state (engagement failure) where the engagement projection 80 is disengaged from the hook member 63 (first engagement groove 63*a*) despite the arm member 61 being in the retraction completion position (at the end point of the guide groove 51*a*) also is similar to that in the first embodiment, that is, as shown in FIG. 10.

In this embodiment, as shown in FIG. 13, the double gear 59 has a ratchet mechanism, and has latches formed on opposed parts of the small- and large-diameter portions 59*a* and 59*b*. Owing to this ratchet mechanism (one-way mechanism), only when the paper feed cassette 10 is retracted into the image forming apparatus 100, as the small-diameter portion 59*a* rotates, the large-diameter portion 59*b* rotates together. Thus, when the paper feed cassette 10 is retracted into the image forming apparatus 100, the first gear 53 rotates in the counter-clockwise direction in FIG. 4, and the rotation driving force is transmitted between the first gear 53 and the double gear 59 via the one-way mechanism. On the other hand, when the paper feed cassette 10 is extracted out of the image forming apparatus 100, the one-way mechanism interrupts transmission of the rotation driving force between the first gear 53 and the double gear 59, and thus the load from the rotary damper 60 is not transmitted from the double gear 59 to the first gear 53.

Moreover, as shown in FIGS. 13 and 14, the small- and large-diameter portions 59*a* and 59*b* are arranged coaxially (on the same rotation axis), and the large-diameter portion 59*b* is so formed as to be movable between a first position (the position shown in FIG. 13), where it is meshed with the small-diameter portion 59*a*), and a second position (the position shown in FIG. 14), where it stands apart from the small-diameter portion 59*a*.

On the top face of the first gear 53 (the face opposite the large-diameter portion 59*b*), a projection portion 54 is provided which is tapered in a large-diameter portion 59*b* side part. The projection portion 54 intervenes between the first gear 53 and the large-diameter portion 59*b* as shown in FIG. 14 immediately before the paper feed cassette 10 reaches (for example, several millimeters off) the retraction completion position (ready-to-feed-paper position) to make the large-diameter portion 59*b* retract from the first position to the second position, where it does not mesh with the small-diameter portion 59*a*.

In the structure according to this embodiment, as described above, there is provided a rotary damper 60 which, when a retraction force generating mechanism (the first gear 53, second gear 55, arm member 61, tension spring 70, etc.) retracts the paper feed cassette 10 inward into the body of the image forming apparatus 100, generates a load commensurate with the retraction speed thereby to suppress increase in the retraction speed. Thus, it is possible to suppress increase in the retraction speed of the paper feed cassette 10, and thus to reduce impact during loading of the paper feed cassette 10.

Providing the retraction force generating mechanism which applies a retraction force to the hook member 63 helps suppress the load on the user during loading of the paper feed cassette 10.

The first gear 53 is provided with the projection portion 54, and immediately before the paper feed cassette 10 reaches the retraction completion position, the projection portion 54 intervenes between the first gear 53 and the large-diameter portion 59*b* and makes the large-diameter portion 59*b* retract from the first position to the second position, where it does not mesh with the small-diameter portion 59*a*. Thus, immediately before the paper feed cassette 10 reaches the retraction completion position during loading of the paper feed cassette 10, the load on the paper feed cassette 10 from the rotary damper 60 discontinues. Thus, it is possible to prevent the retraction force from becoming, before the paper feed cassette 10 reaches the retraction completion position, so low that retraction is halted, and thus to reliably retract the paper feed cassette 10 into the retraction completion position.

The double gear 59 has a ratchet mechanism so that, only when the paper feed cassette 10 is retracted into the body of the image forming apparatus 100, as the small-diameter portion 59*a* rotates, the large-diameter portion 59*b* rotates together. Thus, when the paper feed cassette 10 is extracted out of the image forming apparatus 100, the ratchet mechanism interrupts transmission of the rotation driving force between the first gear 53 and the double gear 59, and thus the load from the rotary damper 60 is not transmitted from the double gear 59 to the first gear 53. It is thus possible to smoothly extract the paper feed cassette 10 without being affected by the load from the rotary damper 60.

Although in this embodiment the projection portion 54 is provided on the first gear 53, the projection portion 54 can instead be provided on the large-diameter portion 59*b* of the double gear 59.

The embodiments described above are in no way meant to limit the present disclosure, and many modifications and variations are possible within the spirit of the present disclosure. For example, although the embodiments described above deal with structures where the first gear 53 to which the arm member 61 is fixed to which one end of the tension spring 70 is hooked is coupled via the idle gear 57 with the second gear 55 on which the boss portion 55*b* is provided to which the other end of the tension spring 70 is hooked, and the first and second gears 53 and 55 rotate in the same direction, the idle gear 57 can be replaced with a linking mechanism that makes the first and second gears 53 and 55 rotate simultaneously in the same direction.

Although the embodiments described above deal with a unit retraction device 50 for retracting a paper feed cassette 10 into the body of an image forming apparatus 100, application is possible not only to a paper feed cassette 10 but equally, in cases where a developing device 4 or a fusing device 9 is insertably or extractably loaded in the body of an image forming apparatus 100, as a retraction device for such a unit.

The present disclosure is applicable not only to monochrome multifunction peripherals like the one shown in FIG. 1 but to any other image forming apparatuses provided with an extractable unit, such as color printers, color multifunction peripherals, monochrome printers, and color multifunction peripherals and color printers provided with an image formation section adopting ink-jet recording.

The present disclosure is applicable to a retraction device for retracting into an apparatus body a unit that is retractably and insertably loaded in the apparatus body. Based on the present disclosure, it is possible to provide, with a simple structure, a unit retraction device that can reliably retract a unit into a predetermined position inside an apparatus body without an undue load on the user.

What is claimed is:

1. A unit retraction device comprising:

a hook member which engages with an engaged portion provided on a unit that is inerrably or extractably loaded in an apparatus body; and a retraction force generating mechanism which exerts a retraction force on the unit when the hook member engages with the engaged portion in a retraction start position of the unit, wherein the retraction force generating mechanism includes a first rotary member which is rotatably disposed on a first rotation pivot and to a rotating end part of which the hook member is rotatably coupled;

a biasing member of which one end is hooked to the first rotary member and which biases the first rotary member in such a direction that the hook member retracts the unit into the apparatus body; and a second rotary member to which another end of the biasing member is hooked, the second rotary member being rotatably disposed on a second rotation pivot, the second rotary member rotating in a same direction as the first rotary member as the first rotary member rotates under a biasing force of the biasing member, and the unit retraction device retracts the unit into a retraction completion position inside the apparatus body.

2. The unit retraction device according to claim 1, wherein the direction in which the biasing member biases changes in such a direction that a rotation moment acting on the first rotary member increases throughout a period from start to completion of retraction of the unit.

3. The unit retraction device according to claim 1, wherein the first rotary member includes an arm member to which the hook member is rotatably coupled and a first gear to which the arm member is fixed and which is rotatable about the first rotation pivot, and the second rotary member is a second gear which is coupled to the first gear via one or more idle gears.

4. The unit retraction device according to claim 3, further comprising a restricting member which is disposed such that a driving force can be transmitted to the first gear and which restricts rotation of the arm member by generating a load commensurate with rotation speed of the first gear over an entire range from the retraction start position to the retraction completion position when the rotary members rotate as the unit is retracted into the apparatus body under the biasing force exerted by the biasing member.

5. The unit retraction device according to claim 4, further comprising a one-way gear which is disposed between the first gear and the restricting member and which allows transmission of a driving force to the first gear only when the unit is retracted into the apparatus body.

6. The unit retraction device according to claim 5, wherein the one-way gear is a double gear including a small-diameter gear which engages with the first gear and a large-diameter gear which is arranged coaxially with the small-diameter gear, the large-diameter gear being movable between a first position where the large-diameter gear is meshed with the small-diameter gear and a second position where the large-diameter gear stands apart from the small-diameter gear, the large-diameter gear being coupled to the restricting member, and on the first gear or the large-diameter gear, a projection portion is provided which interposes between the first gear and the large-diameter gear to move the large-diameter gear from the first position to the second position immediately before the unit reaches the retraction completion position.

7. The unit retraction device according to claim 6, wherein the double gear has a ratchet mechanism between the small-diameter gear and the large-diameter gear, and the large-diameter gear rotates as the small-diameter gear rotates only when the unit is retracted into the apparatus body.

8. The unit retraction device according to claim 1, wherein the hook member is rotatably coupled to the arm member, and has a first engagement groove which engages with the engaged portion and a locking portion which engages with a claw portion provided near the retraction start position, and engagement between the claw portion and the locking portion is released as a result of the engaged portion engaged with the hook member pressing the hook member to make the hook member rotate.

9. The unit retraction device according to claim 1, wherein the unit is a recording medium storage cassette for storing a recording medium.

10. image forming apparatus comprising the unit retraction device according to claim 1.

* * * * *